US005890729A

United States Patent [19]

Bayer et al.

[11] Patent Number: 5,890,729

[45] Date of Patent: Apr. 6, 1999

[54] ROTATABLY ADJUSTABLE SNOWBOARD BINDING ASSEMBLY

[75] Inventors: Seth W. Bayer, Boulder, Colo.; Gerald R. Anderson, Campbell; Wiley A. Kittrell, Fremont, both of Calif.

[73] Assignee: Items International, Inc., Altoona, Pa.

[21] Appl. No.: 760,761

[22] Filed: Dec. 5, 1996

[51] Int. Cl.[6] ..... A63C 9/081

[52] U.S. Cl. ..... 280/618

[58] Field of Search ..... 280/14.2, 607, 280/618, 613, 630; 269/66, 68

[56] References Cited

U.S. PATENT DOCUMENTS

| | | | |
|---|---|---|---|
| 4,728,116 | 3/1988 | Hill | 280/618 |
| 4,871,337 | 10/1989 | Harris | 280/14.2 X |
| 4,964,649 | 10/1990 | Chamberlin | 280/618 |
| 5,021,017 | 6/1991 | Ott | 441/70 |
| 5,028,068 | 7/1991 | Donovan | 280/618 |
| 5,044,654 | 9/1991 | Meyer | 280/613 |
| 5,190,311 | 3/1993 | Carpenter et al. | 280/618 |
| 5,261,689 | 11/1993 | Carpenter et al. | 280/618 |
| 5,277,635 | 1/1994 | Gillis | 441/74 |
| 5,354,088 | 10/1994 | Vetter et al. | 280/618 |
| 5,356,170 | 10/1994 | Carpenter et al. | 280/618 |
| 5,433,636 | 7/1995 | Gillis | 441/74 |
| 5,480,176 | 1/1996 | Sims | 280/618 |
| 5,499,837 | 3/1996 | Hale et al. | 280/618 X |
| 5,553,883 | 9/1996 | Erb | 280/607 |
| 5,577,755 | 11/1996 | Metzger et al. | 280/14.2 X |
| 5,584,492 | 12/1996 | Fardie | 280/14.2 |
| 5,586,779 | 12/1996 | Dawes et al. | 280/14.2 |
| 5,667,237 | 9/1997 | Lauer | 280/618 X |

*Primary Examiner*—Robert J. Oberleitner
*Assistant Examiner*—C. T. Bartz
*Attorney, Agent, or Firm*—Reed Smith Shaw & McClay LLP

[57] ABSTRACT

A rotatably adjustable binding assembly provides for quick and easy rotational adjustment of the binding assembly from a preset first rotational position to a preset second rotational position while a person's foot remains engaged in the binding assembly. The binding assembly includes a detent mechanism mounted under a foot base that engages at least one plate element whereby engagement of the detent mechanism with the plate element secures the binding assembly at a first or second rotational position. Operation of a foot tab actuates the detent mechanism, thereby permitting a "hands free" method of adjusting the rotational position of the binding assembly.

29 Claims, 16 Drawing Sheets

ROTATABLY ADJUSTABLE SNOWBOARD BINDING ASSEMBLY

BACKGROUND OF THE INVENTION

The present invention relates generally to the field of binding assemblies and, more particularly, to an improved binding assembly for snowboards.

Over the last decade, snowboarding has become a very popular winter sport in the United States and other countries. While skiing and snowboarding are usually performed on the same slopes, they differ significantly from each other. For example, rather than having separate skis for each foot and poles for each hand, a snowboarder has both feet bound to a single, relatively wide board, and no poles are used. In addition, unlike skiing, snowboard bindings are mounted on the snowboard at a transverse angle to the longitudinal axis of the snowboard.

While it is relatively easy for snowboarders to propel themselves down a slope with both of their feet secured to the snowboard, difficulties are encountered when snowboarders attempt to traverse level ground where they cannot take advantage of gravity forces as a means of propulsion. The need for traversing level ground routinely arises when snowboarders seek to transport themselves to a chair lift to be taken to the top of a slope to begin their downhill ride.

Because snowboarders do not use poles, when maneuvering over level ground snowboarders typically must remove at least one foot from the snowboard and propel themselves along the ground in a "skateboard" fashion, i.e., the rear foot is used to push on the ground surface and propel the snowboard while the front foot remains inserted in the snowboard binding and is used to guide the path of travel of the snowboard. The ability of snowboarders to easily and safely propel themselves in "skateboard" fashion is hindered by the fact that the bindings securing the snowboarder's foot to the snowboard are typically mounted at a transverse angle to the longitudinal axis of the snowboard. This results in the snowboarder's front foot being turned inwards at what may be an uncomfortable and potentially hazardous position to the snowboarder's knee and ankle should the snowboarder choose to propel the snowboard in skateboard fashion rather than disengage both feet from the snowboard before attempting to maneuver over level ground. Conversely, should the snowboarder choose to mount the binding at an angle that is safe for the "skateboard" method of ground maneuvering, the rotational position of the binding may not be satisfactory or safe for the individual snowboarder to use when riding the snowboard down a slope. Therefore, a snowboard binding assembly capable of adjusting the rotational position of the binding so that the snowboarder can quickly and easily position the binding for safe maneuvering over level ground in "skateboard" fashion and then easily readjust the binding to a "riding angle" proper for riding the snowboard down a slope, without removing the boot from the binding assembly, has been desired.

SUMMARY OF THE INVENTION

The present invention provides an adjustable binding assembly for a snowboard that allows a snowboarder to quickly and conveniently alter the rotational position of the binding assembly between a first and second rotational position without requiring the removal of the snowboarder's boot from the binding assembly during the adjustment. The first rotational position permits the transverse angle the binding makes with the snowboard's longitudinal axis to be set for maneuvering the snowboard over level ground in a "skateboard" fashion. The second rotational position sets the riding angle of the binding assembly to a position suitable for riding the snowboard down a slope. A mechanism to securely lock the adjusted rotational position and permit an easy release of the locked position for rotational readjustment is also provided. Through the operation of a foot tab, which foot tab is actuated by the snowboarder's free foot, the rotational adjustment of the binding assembly between the first and second rotational positions can be accomplished in a "hands free" operation. In addition, the present invention provides a mechanism for easily altering the preset second rotational position to accommodate the snowboarder's individual preference for the riding angle prior to insertion of the boot into the binding assembly.

According to a first aspect of the present invention, the rotatably adjustable binding assembly includes a foot base, a bottom plate, a set ring, a locking disk, a detent lever, and a top plate. The foot base is adapted to receive and secure a boot. Further, the foot base contains an annular surface defining a through hole. The bottom plate is mounted on a snowboard concentric with the foot base through hole. The set ring is disposed above the bottom plate, concentric with the foot base through hole, and is free to rotate about its axis. The set ring contains a notch on its outer perimeter and gear teeth that matingly engage the locking disk on its inner perimeter. When engaged with the locking disk, the rotational position of the set ring notch is fixed. The foot base is disposed on top of the set ring. A detent lever is pivotally mounted on the foot base. The bottom plate contains a notch on its outer perimeter that can engage the detent lever via a pawl. When the pawl is engaged in the bottom plate notch, the foot base is secured at a first rotational position. A second rotational position of the foot base is secured by operating the detent lever and rotating the foot base so that the pawl engages the notch on the set ring. By releasing the locking disk from the set ring and maneuvering the set ring to a different rotational position, thereby repositioning the notch on the set ring, the second rotational position of the foot base can be varied by the snowboarder to accommodate the snowboarder's riding angle preference.

According to a second aspect of the present invention, the rotatably adjustable binding assembly includes a foot base, a detent mechanism, and first and second plate elements. The foot base has a through hole and is secured to a snowboard, but is free to rotate about the through hole axis. Each plate element is concentric with the foot base through hole and contains a notch or other suitable detent engaging element on its respective outer perimeter. Engagement of the detent mechanism with a notch of one of the plate elements secures the rotational position of the binding assembly at a first rotational position. Engagement of the detent mechanism with the notch from the other plate element secures the binding assembly at a second rotational position.

According to a third aspect of the present invention the rotatably adjustable binding assembly includes a foot base, a detent mechanism and a single plate containing a plurality of notches or other suitable detent engaging elements. Engagement of the detent mechanism in an individual detent engaging element secures the binding assembly at a particular rotational position. Engagement of the detent mechanism in other detent engaging elements secures the binding assembly at other rotational positions.

The present invention, together with other aspects and attendant advantages, will best be understood upon consideration of the following detailed description taken in conjunction with the accompanying drawings.

DETAILED DESCRIPTION OF THE PRESENTLY PREFERRED EMBODIMENTS

Typically, every snowboard or similar device includes two binding assemblies-one for each boot worn by the snowboarder. While it is anticipated that the rotatably adjustable binding assembly described herein would normally be used for the front binding, the rotatably adjustable binding assembly can also be adapted for use on the rear binding thereby permitting the snowboarder to switch between two discrete rear leg riding angles. However, for ease of explanation, the present invention is described below in terms of a single binding assembly.

Figure 1:
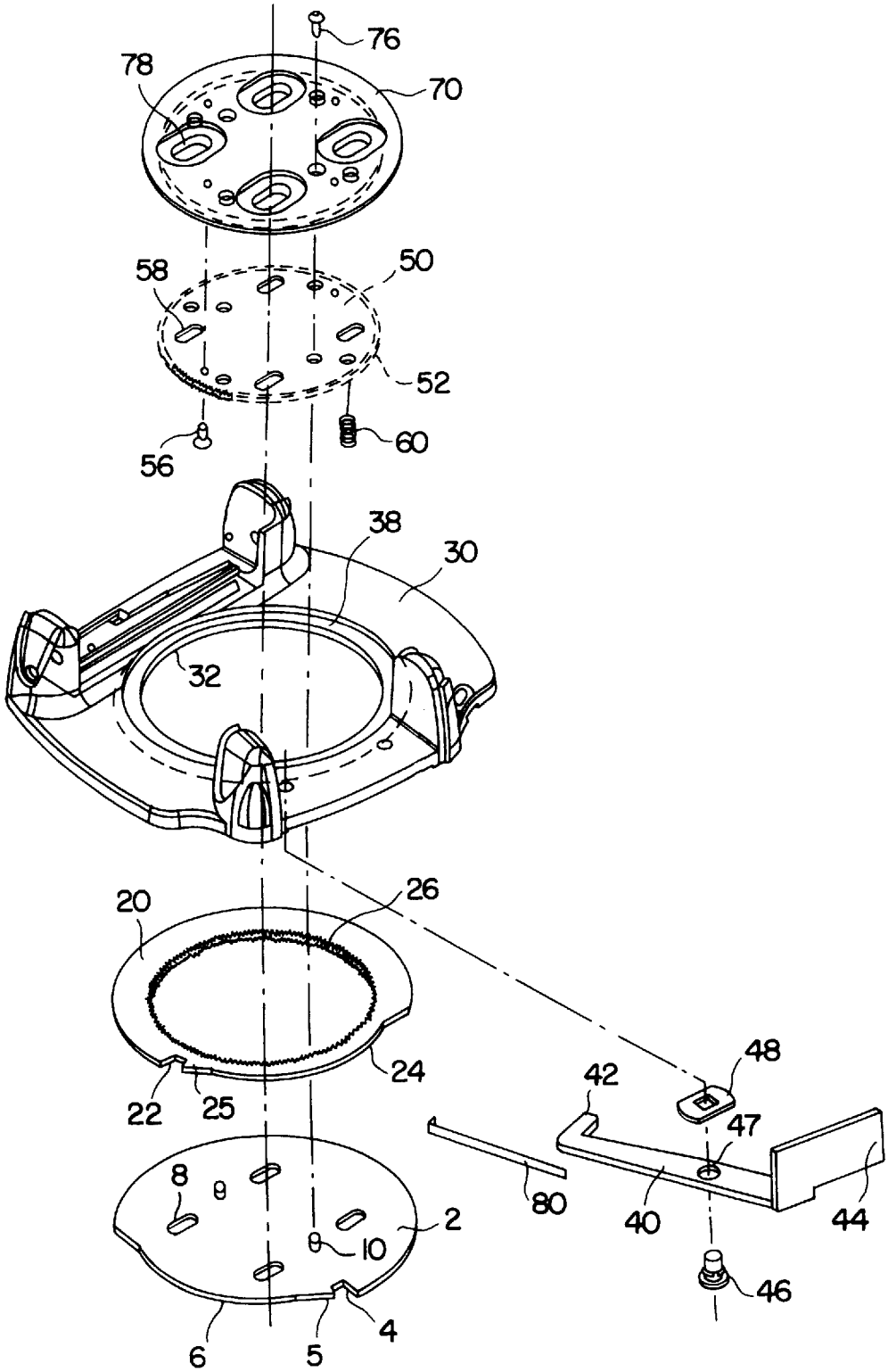
FIG. 1 is an exploded perspective view of the first preferred embodiment of the binding assembly of the present invention.

Turning now to the drawings, as shown in FIG. 1, the rotatably adjustable binding assembly generally comprises a bottom plate 2, a set ring 20, a foot base 30, a detent lever 40, a locking disk 50, and a top plate 70.

Figure 4:
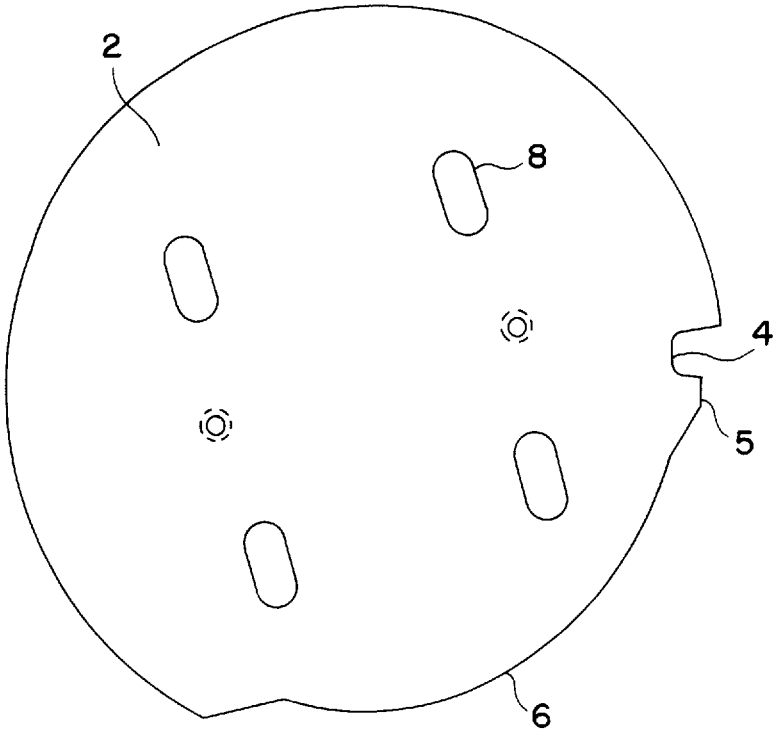
FIG. 4 is a top view of the bottom plate of the present invention.
Figure 4A:
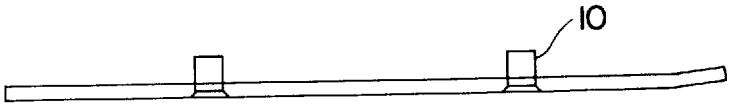
FIG. 4*a* is a side view of the bottom plate of the present invention.

As shown in FIG. 4, in a preferred embodiment, the bottom plate 2 has an outer periphery that is substantially circular in shape. The bottom plate contains a detent receiving element, such as a notch 4, along its outer perimeter. The detent receiving element is shaped to accommodate a corresponding detent member, such as a pawl 42, that is attached to a detent lever 40. In a preferred embodiment, the detent receiving element and detent member are slightly wedged shaped. A cam surface 6 is defined along a portion of the outer perimeter of the bottom plate at a radius smaller than the radius of the substantially circular portion of the bottom plate. During rotational adjustment of the foot base 30, the pawl 42 travels along the cam surface 6. A ridge 5 exists at the intersection of the cam surface 6 with the notch 4. The ridge aides in preventing the pawl 42, once engaged in the notch 4, from inadvertently disengaging. In a preferred embodiment, the ridge and notch can be slightly angled upward to provide for better engagement of the pawl with the notch, (see FIG. 4*a*).

The bottom plate also contains mounting slots 8 for receiving bolts or other fastening devices extending from or terminating in the snowboard. The fastening devices are used to secure the binding assembly to the snowboard and thereby fix the angular position of the notch 4 of the bottom plate. In a preferred embodiment, four slots are utilized to correspond to the four screws conventionally used in snowboards to mount binding assemblies to the snowboards. The number and shape of the slots is not critical so long as they correspond to the fastening mechanism present on the snowboard.

When the bottom plate is secured to the snowboard, the rotational position of the notch 4 is fixed. Engagement of the pawl 42 with the notch 4 will fix a preset first rotational position of the foot base 30 with respect to the longitudinal axis of the snowboard based on the fixed position of the notch 4. By changing the fixed position of the notch 4 along the outer perimeter of the bottom plate relative to the mounting slots 8, the first rotational position of the foot base 30 with respect to the longitudinal axis of the snowboard can be set at different rotational positions. The optimal or preferred rotational position of the foot base will vary for each individual snowboarder. In a preferred embodiment, the notch 4 is positioned such that the foot base 30 is positioned twenty degrees from the longitudinal axis of the snowboard. Twenty degrees from the longitudinal axis is deemed to be within the optimal angle range for "skateboard" pushing. However, other rotational positions, including those between zero and twenty degrees, are easily achieved through varying the rotational position of the notch 4.

Figure 5:
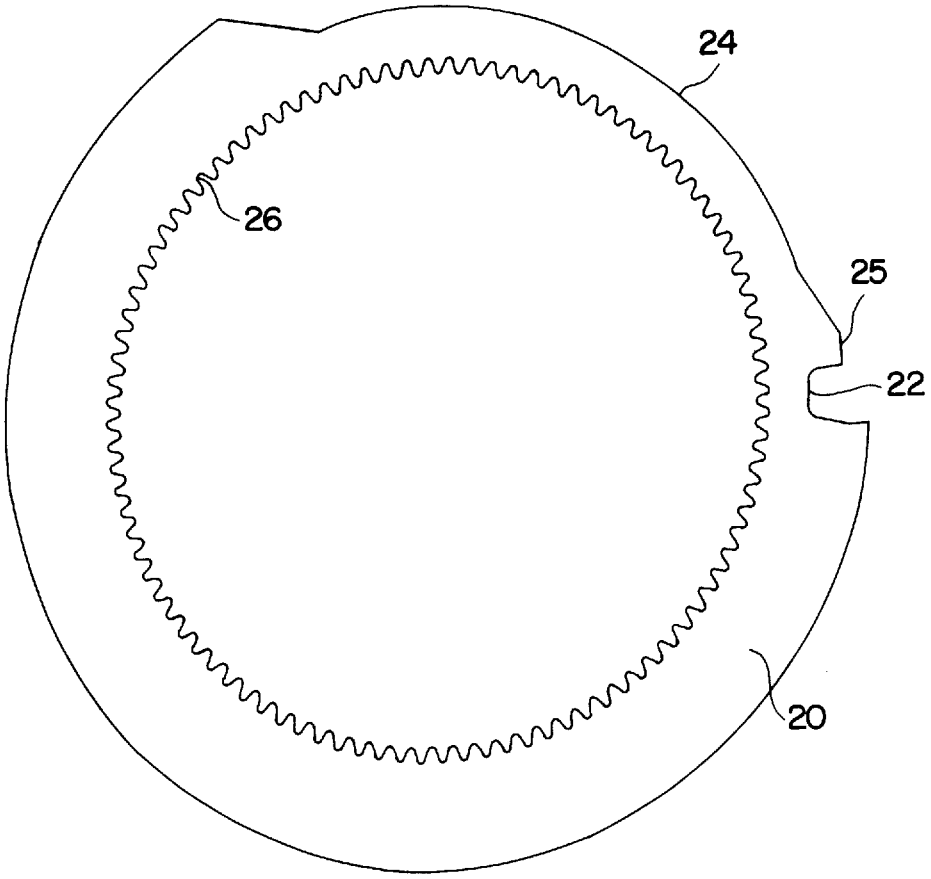
FIG. 5 is a top view of the set ring of the present invention.
Figure 5A:
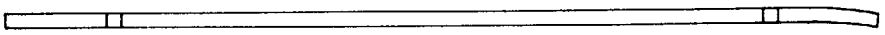
FIG. 5*a* is a side view of the set ring of the present invention.

A set ring 20 is disposed above the bottom plate 2. The set ring is free to rotate about its axis relative to the fixed bottom plate 2. As shown in FIG. 5, in a preferred embodiment, the set ring 20 has an outer periphery substantially circular in shape. In a preferred embodiment, the radius of the substantially circular portion of the set ring 20 is the same as the radius of the substantially circular portion of the bottom plate 2. The set ring contains a detent receiving element, such as a notch 22, along its outer perimeter. The detent receiving element is shaped to accommodate the pawl 42 of the detent lever 40. Engagement of the pawl 42 with the notch 22 will fix a preset second rotational position of the foot base 30 with respect to the longitudinal axis of the snowboard based on the rotational position of the notch 22. A cam surface 24 is defined along a portion of the outer perimeter of the set ring at a radius smaller than the radius of the substantially circular portion of the set ring. During rotational adjustment of the foot base 30, the pawl 42 travels along the cam surface 24. A ridge 25 exists at the intersection of the cam surface 24 with the notch 22. The ridge aides in preventing the pawl 42, once engaged in the notch 22, from inadvertently disengaging. In a preferred embodiment, the ridge and notch can be slightly angled to provide for better engagement of the pawl with the notch, (see FIG. 5*a*).

The set ring also contains an inner periphery 26. The inner periphery is adapted to matingly engage the locking disk 50. In one embodiment, the inner periphery contains gear teeth that correspond and mesh with gear teeth 52 on the locking disk.

Figure 3:
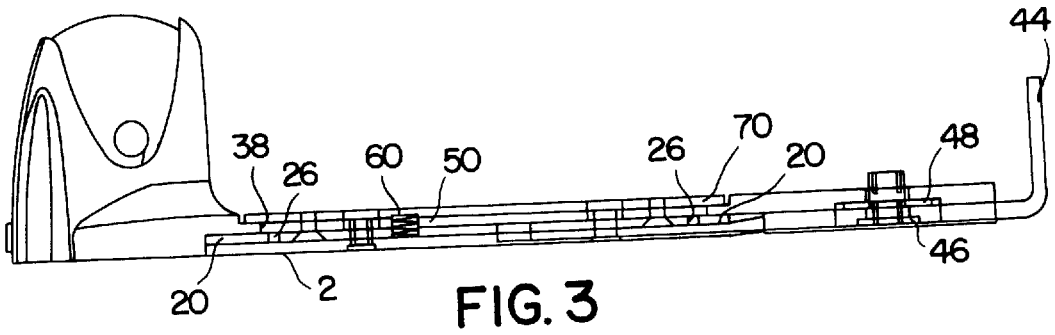
FIG. 3 is a side section view of the first preferred embodiment of the binding assembly of the present invention along section line II'.
Figure 6:
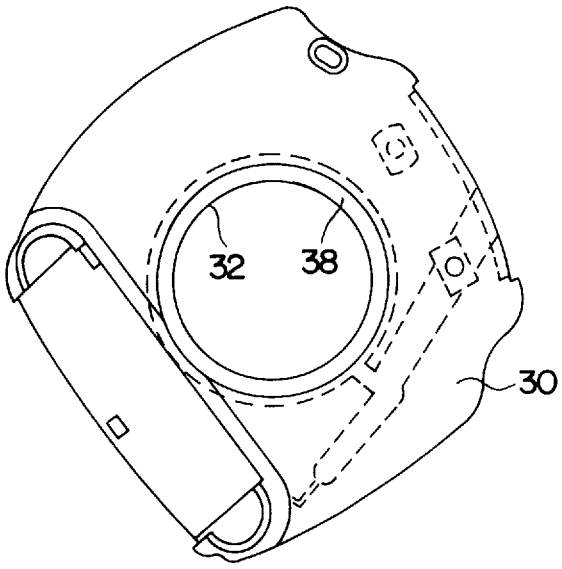
FIG. 6 is a top view of the foot base of the present invention.
Figure 6A:
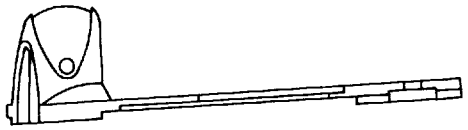
FIG. 6*a* is a side view of the foot base of the present invention.

A foot base 30, as shown in FIGS. 1 and 6, is disposed over the set ring 20 and the bottom plate 2. The foot base 30 is adapted to receive and secure thereto a boot using methods know by those of ordinary skill in the art for securing boots to foot bases, such as those disclosed in U.S. patent application Ser. No. 08/700,743 filed on Jul. 9, 1996, now abandoned; and PCT International Application Serial Number US96/02806 filed on Feb. 29, 1996, the disclosures of which are incorporated herein by reference. The foot base contains an annular surface defining a lip 38 and a through hole 32. The axis of the through hole 32 defines the axis of rotation for the rotational adjustments of the binding assembly. In a preferred embodiment, the bottom plate 2 and the set ring 20 are concentric with the through hole 32 and disposed within the foot base under the lip 38, (see FIG. 3).

A detent lever 40 is pivotally mounted in a substantially horizontal position on the underside of the foot base 30 through the use of a thumb screw 46 and washer 48 or some other fastening mechanism know to those of ordinary skill in the art that will permit the lever to pivot about the mounting point. A pivot point 47 is defined along the axis of the thumb screw 46. The detent lever includes a detent member, such as a pawl 42, mounted at the end of the lever. The detent member is shaped to correspondingly engage the detent receiving element, notch 4, of the bottom plate 2 and the detent receiving element, notch 22, of the set ring 20. The detent lever also includes a foot tab 44, protruding from the foot base substantially perpendicular to the detent lever. The foot tab is sized so that it can be easily actuated by the user's free foot. Such foot actuation allows for a "hands free" operation of the binding assembly. In a preferred embodiment, the foot tab protrudes from the medial side of the binding assembly.

Figure 2:
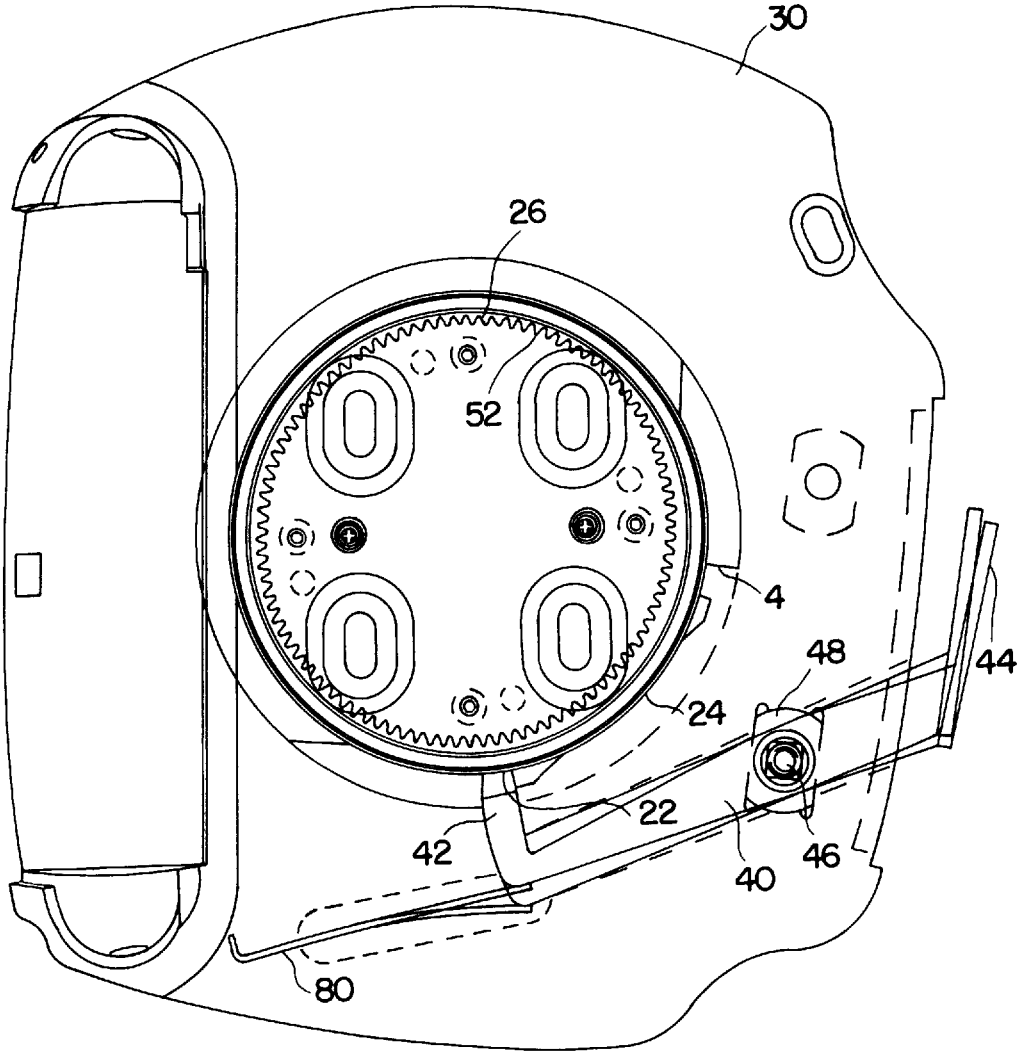
FIG. 2 is a bottom view of the first preferred embodiment of the binding assembly of the present invention.
Figure 6B:
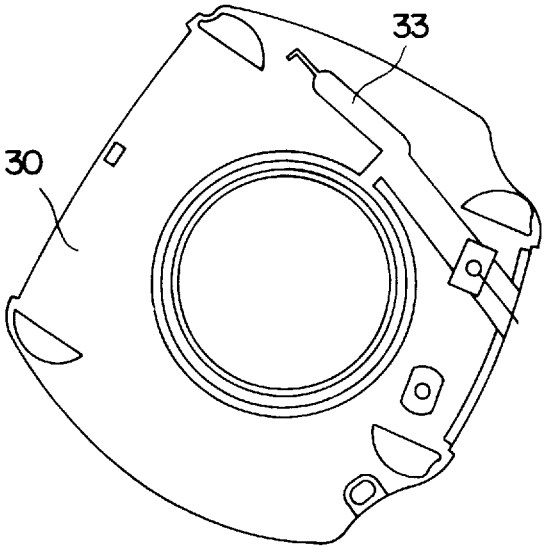
FIG. 6*b* is a bottom view of the foot base of the present invention.

As shown in FIG. 2, a detent spring 80 is mounted under the foot base 30 and engages the rear portion of the pawl 42. The detent spring provides a means for urging the pawl 42 into either the notch 4 of the bottom plate 2 or the notch 22 of the set ring 20 depending on the rotational position of the foot base. In a preferred embodiment, the underside of the foot base 30 has a channel 33 adapted to receive the detent lever 40 and the detent spring 80, (see FIG. 6*b*). In another embodiment of the invention, the detent spring comprises a lever spring. Although it is not depicted in FIGS. 2 or 6*b*, a fulcrum may be disposed behind the detent spring to increase the spring force that the lever spring can exert against the pawl. Those of ordinary skill in the art will also appreciate that a compression spring element mounted substantially horizontal can be substituted for the lever spring as providing the means for urging the pawl into the respective notches.

Figure 7A:
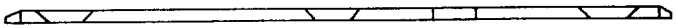
FIG. 7*a* is a side view of the locking disk of the present invention.
Figure 7B:
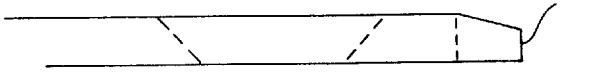
FIG. 7*b* is an enlarged side view of the edge of the locking disk of the present invention.
Figure 7:
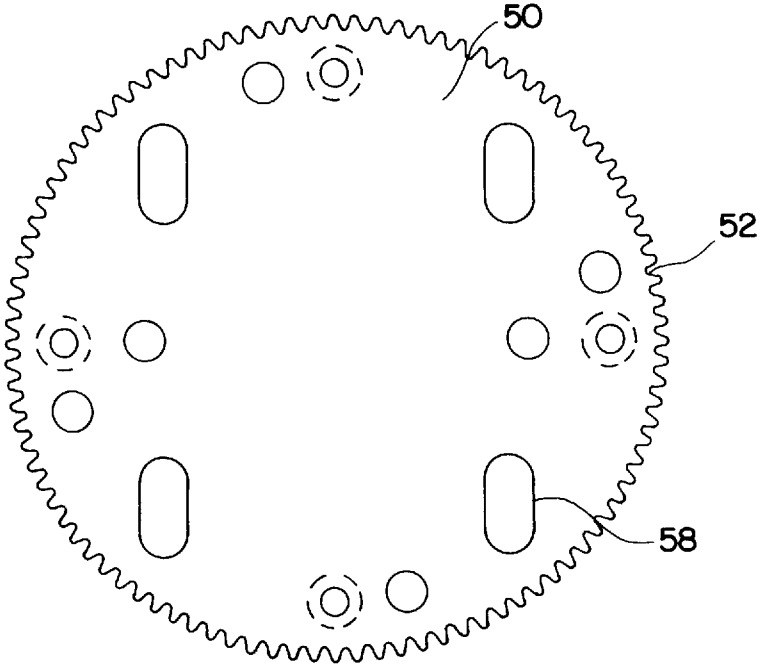
FIG. 7 is a top view of the locking disk of the present invention.
Figure 8A:
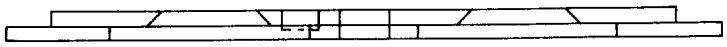
FIG. 8*a* is a side view of the top plate of the present invention.
Figure 8:
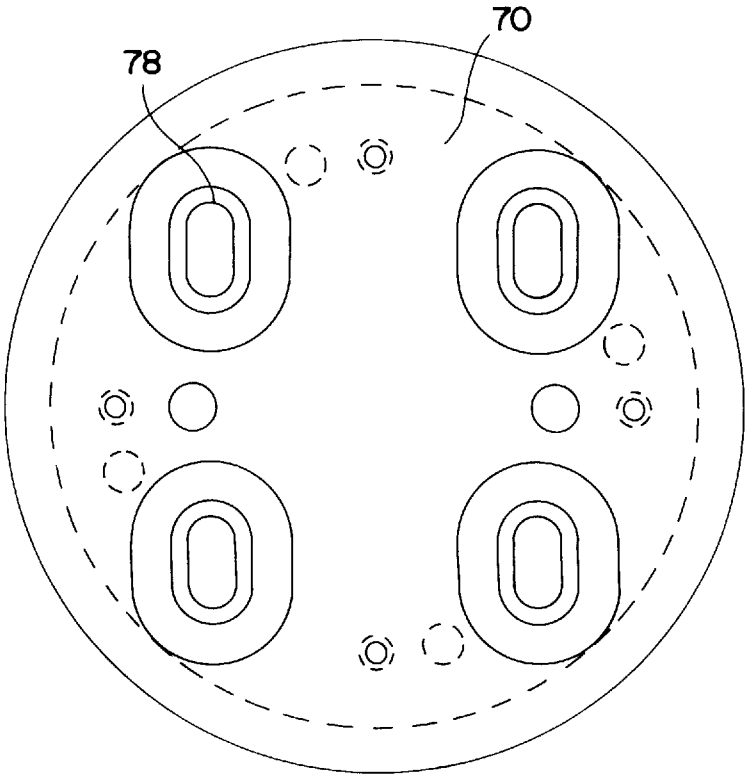
FIG. 8 is a top view of the top plate of the present invention.
Figure 9:
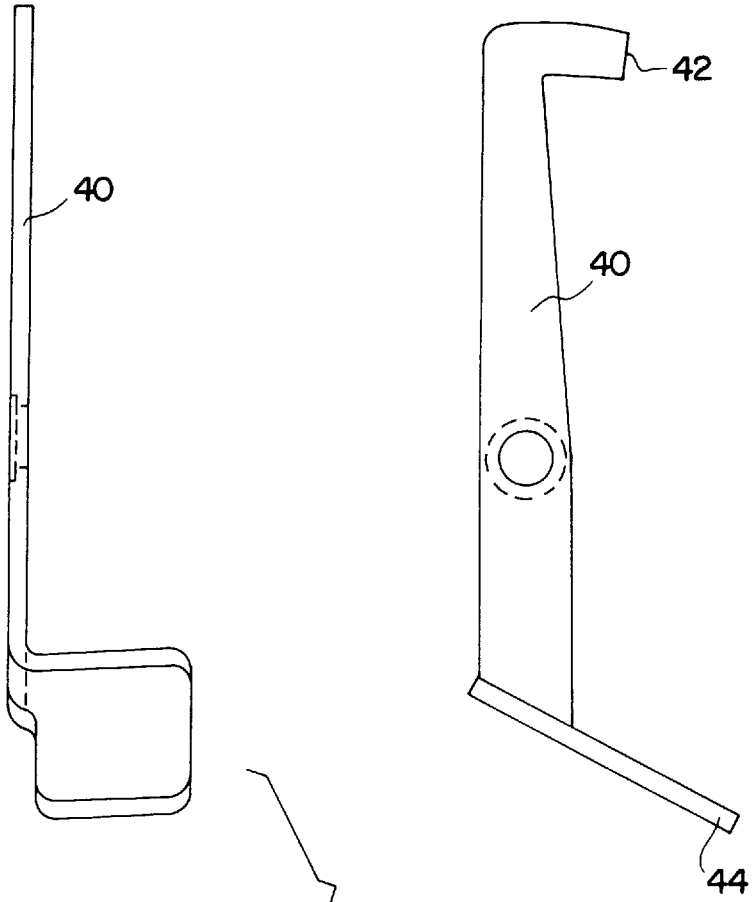
FIG. 9 is a top view of the detent lever of the present invention.
Figure 9A:
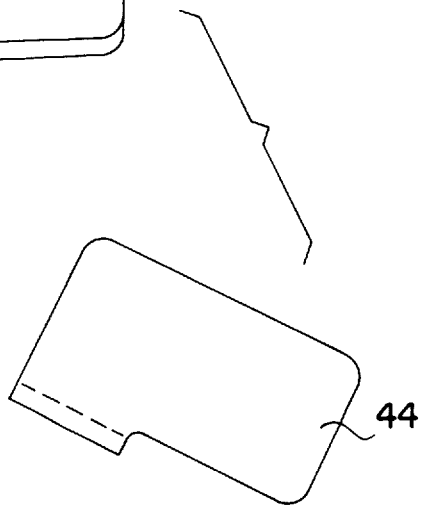
FIG. 9*a* is a side view of the detent lever of the present invention.

A circular shaped locking disk 50 is disposed concentric with the foot base through hole 32 and adapted to matingly engage the inner periphery of the set ring 20. The locking disk has a radius smaller than the radius of the foot base through hole 32. In one alternative embodiment of the present invention, the locking disk has gear teeth along its outer perimeter 52 that correspond and mate to gear teeth 26 along the inner periphery of the set ring 20. As shown in FIG. 7*b*, the edges of the locking disk can be angled to facilitate engagement of the locking disk with the set ring. The locking disk also contains slots 58 that correspond to the mounting slots 8 of the bottom plate 2 and also receive bolts or other fastening devices extending from or terminating in the snowboard. The fastening devices received by slots 58 fix rotationally the locking disk.

A spring biasing means is disposed between the locking disk 50 and the bottom plate 2 to facilitate separation of the locking disk 50 from the set ring 20 during adjustment of the preset second rotational position. In an embodiment of the present invention, the spring biasing means comprises a plurality of axial compression springs 60 disposed substantially perpendicular to the top surface of the bottom plate and bottom surface of the locking disk. Other spring arrangements can be utilized, including the use of a single spring mounted concentric with the axis of the locking disk. If multiple springs are used it is preferred that the springs be arranged such that the axial force exerted by the springs on the locking disk and the resulting moments generated thereby do not cause the locking disk to tip, but result in an upward axial force with no net bending moment.

A circular shaped top plate 70 extends over the annular surface 38 of the foot base 30. The locking disk 50 is secured to the top plate through a fastener 56. In one embodiment of the invention the top plate is integral with the locking disk. In a preferred embodiment, of the invention, fastening mechanisms 76 and 10 fasten the top plate to the bottom plate, thereby securing the top plate 70, locking disk 50, set ring 20, and bottom plate 2, to the foot base 30, independently of the fastening mechanism that secures the binding assembly to the snowboard. The top plate further contains mounting slots 78 that correspond to the mounting slots 8 and 58 and are used to secure the binding assembly to the snowboard.

When the locking disk 50 engages the set ring 20, the set ring is no longer free to rotate about its axis and the rotational position of the notch 22 becomes fixed. As previously noted, engagement of the pawl 42 with the notch 22 fixes the preset second rotational position of the foot base 30 with respect to the longitudinal axis of the snowboard based on the fixed position of the notch 22. By changing the rotational position of the notch 22 relative to the locking disk mounting slots 58, the second rotational position of the foot base 30 with respect to the longitudinal axis of the snowboard can be varied by the snowboarder to accommodate the snowboarder's riding angle preference.

To change the rotational position of the notch 22, the pawl 42 is first engaged in the notch 22. The fastening devices securing the binding assembly to the snowboard through mounting slots 8, 58, and 78 are loosened such that the locking disk 50 can be disengaged from the set ring 20. The spring biasing means 60 facilitates the disengagement of the locking disk from the set ring by exerting an upward axial force on the locking disk. Once free of the locking disk, the snowboarder rotates the foot base 30 with the pawl 42 still engaged in the notch 22 until the desired riding angle is achieved. Rotation of the foot base with the pawl engaged in the notch will result in a rotation of the set ring. Once the new riding angle is set, the locking disk is then re-engaged with the set ring, thereby securing the desired riding angle at the second rotational position. It is noted that if gear teeth are used to matingly engage the locking disk with the set ring, the precision of the rotational positions that can be selected will vary with the number of gear teeth present. Preferably, the gear teeth should be spaced at least every five degrees, more preferably the spacing should be at least two degrees, and even more preferably the spacing could be one degree, or lower, if manufacturing capabilities permit.

Figure 10:
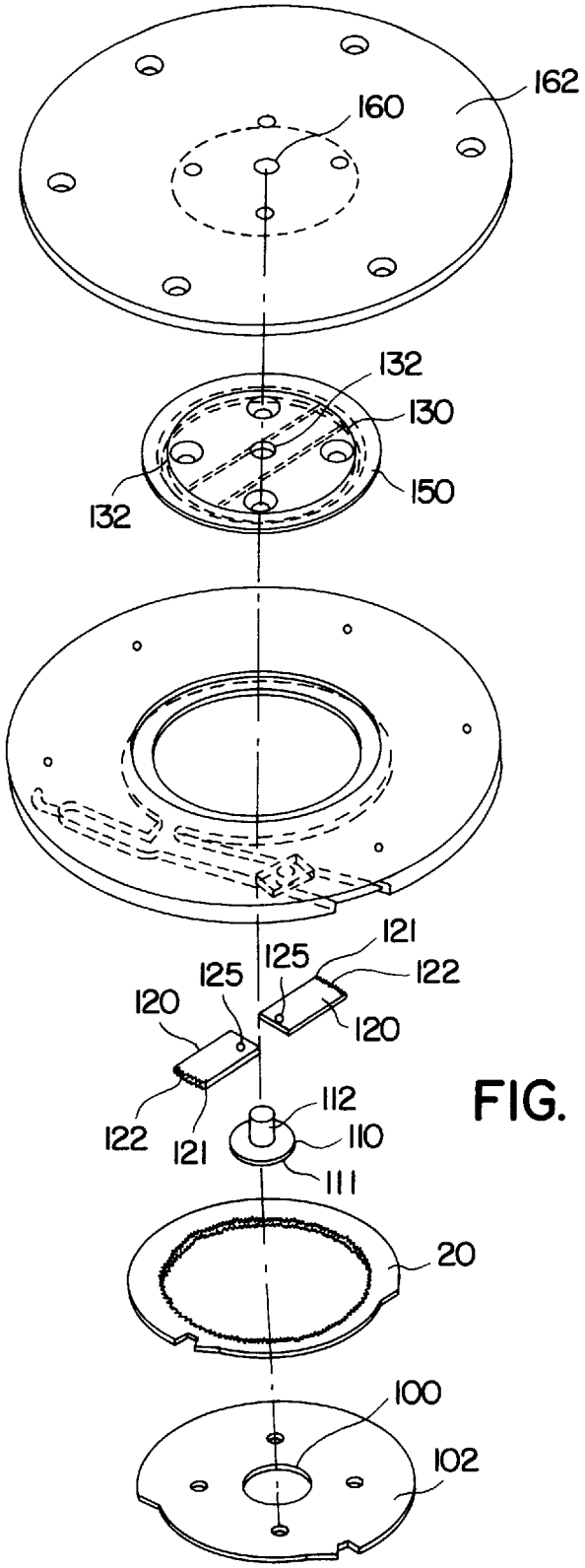
FIG. 10 is an exploded perspective view of a second preferred embodiment of the binding assembly of the present invention.
Figure 11:
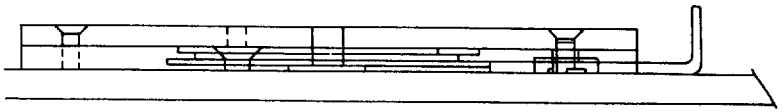
FIG. 11 is a side view of a second preferred embodiment of the binding assembly of the present invention.
Figure 13:
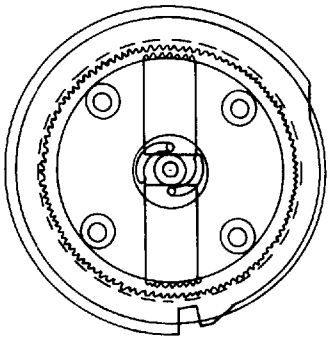
FIG. 13 is a top view of a second preferred embodiment of the binding assembly of the present invention excluding the modified top plate and detent lever.
Figure 12:
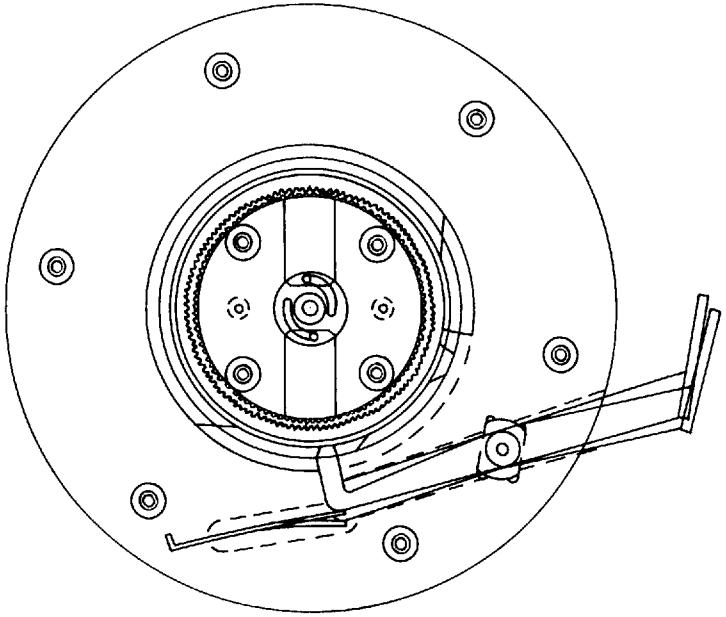
FIG. 12 is a top view of a second preferred embodiment of the binding assembly of the present invention.
Figure 14:
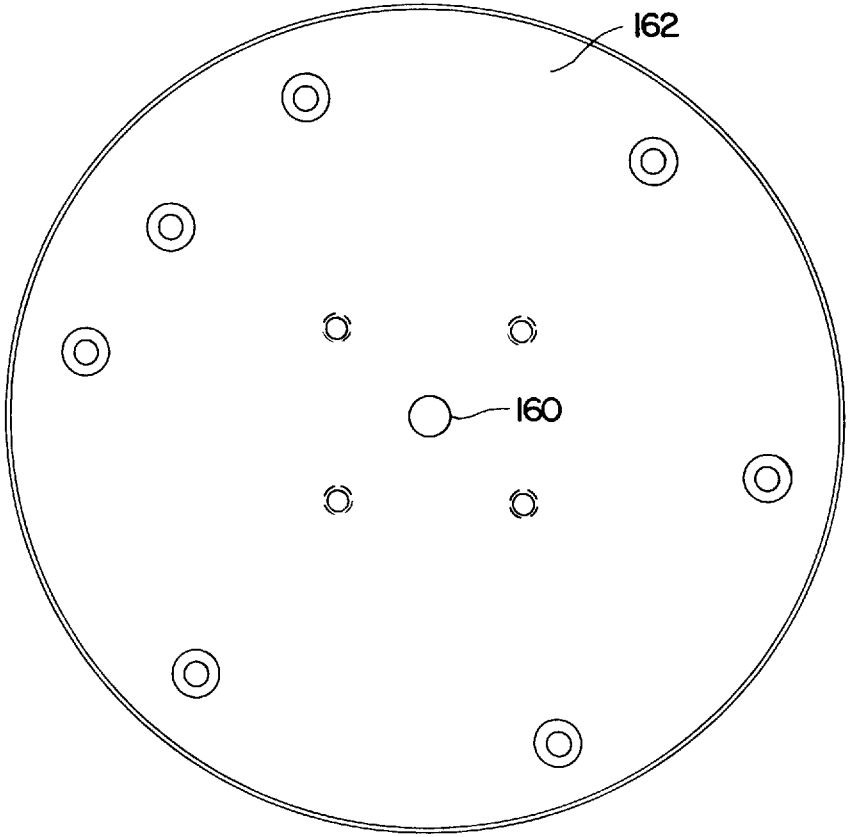
FIG. 14 is a side view of the modified top plate of the second preferred embodiment of the binding assembly of the present invention.
Figure 14A:
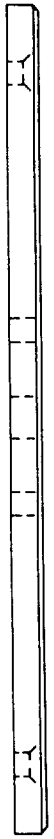
FIG. 14*a* is a side view of the modified top plate of the second preferred embodiment of the binding assembly of the present invention.
Figure 15:
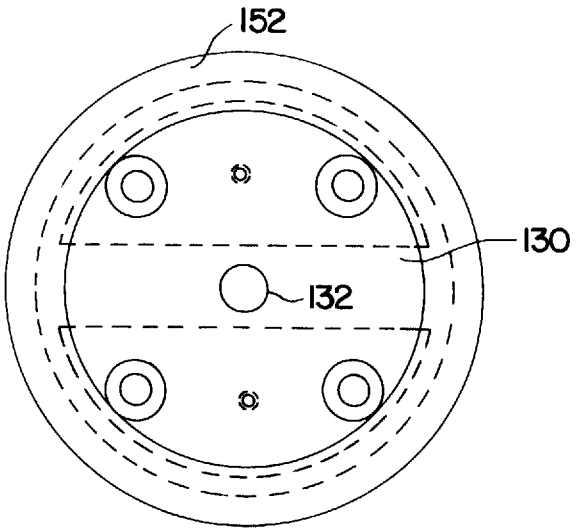
FIG. 15 is a top view of the modified locking disk of the second preferred embodiment of the present invention.
Figure 15A:
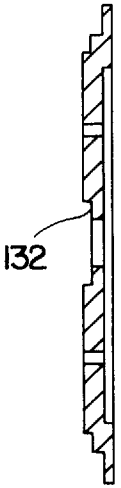
FIG. 15*a* is a side view of the modified locking disk of the second preferred embodiment of the present invention.
Figure 16:
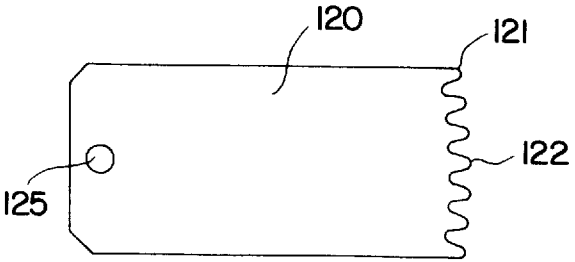
FIG. 16 is a top view of the locking member of the second preferred embodiment of the present invention.
Figure 16A:
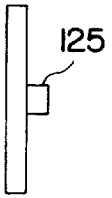
FIG. 16*a* is a side view of the locking member of the second preferred embodiment of the present invention.
Figure 17:
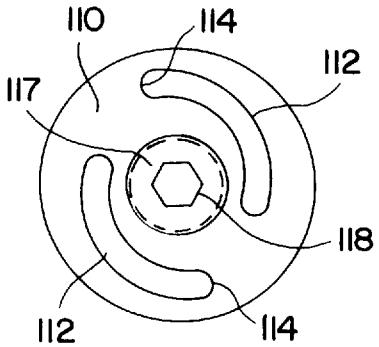
FIG. 17 is a top view of the hub of the second preferred embodiment of the present invention.
Figure 17A:
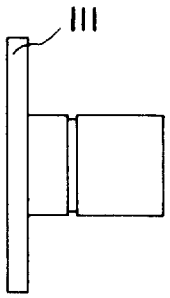
FIG. 17*a* is a side view of the hub of the second preferred embodiment of the present invention.
Figure 18A:
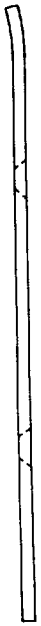
FIG. 18*a* is a side view of the modified bottom plate of the second preferred embodiment of the present invention.
Figure 18:
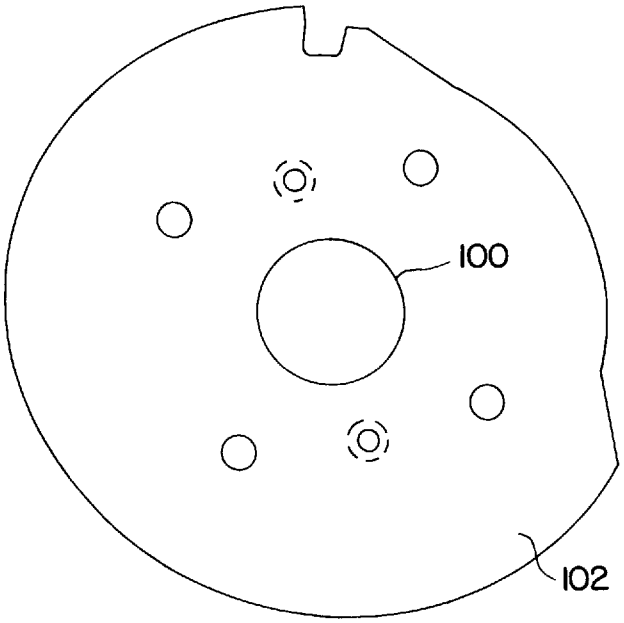
FIG. 18 is a top view of the modified bottom plate of the second preferred embodiment of the present invention.
Figure 19:
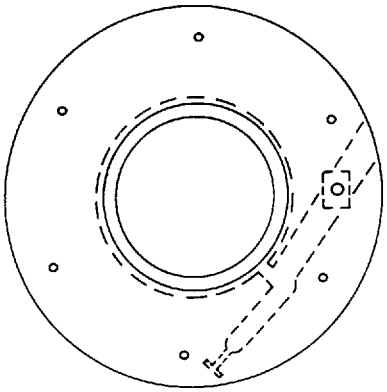
FIG. 19 is a top view of the foot base of the second preferred embodiment of the present invention.
Figure 19A:
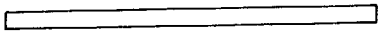
FIG. 19*a* is a side view of the foot base of the second preferred embodiment of the present invention.
Figure 19B:
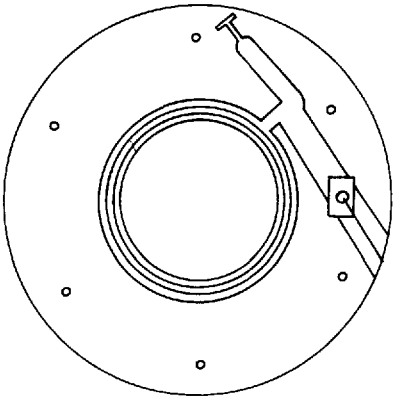
FIG. 19*b* is a bottom view of the foot base of the second preferred embodiment of the present invention.

In a preferred alternative embodiment of the present invention, a locking assembly is provided whereby the rotational position of the notch 22 can be changed without requiring loosening of the fastening devices securing the binding assembly to the snowboard through mounting slots 8, 58, and 78 or the presence of the spring biasing means 60. In one embodiment, the locking assembly comprises a modified locking disk 150 containing at least one horizontal channel 130 radially disposed within a portion of the locking disk (see FIGS. 10 and 15, showing two radial channels disposed 180 degrees from each other). A retractable locking member 120 is slidably disposed within the channel 130. In an alternative embodiment of the invention, as depicted in FIG. 10, two locking members 120 are oppositely and slidably disposed within the channels 130. Each locking member has a first engaging end 121 adapted to matingly engage the inner periphery of the set ring 20. In a preferred embodiment, the first engaging end 121 of the locking member 120 has a radius of curvature the same as the radius of the inner periphery of the set ring 20. As shown in FIG. 16, gear teeth 122 are situated along the first engaging end and adapted to mate with the gear teeth 26 situated along the inner periphery of the set ring 20. A hub 110, adapted to engage the locking members, such that rotation of the hub causes the locking members to move within the channel and thereby engage a portion of the inner periphery of the set ring 20, is disposed between the locking members 120 concentric with the axis of the locking disk. The hub contains spiral grooves 112 (see FIG. 17) that engage pins 125 that protrude substantially perpendicular from the surface of the locking members 120 (see FIG. 16*a*). When the hub 110 is rotated, the pins 125 of the locking members 120 are forced along the walls of the spiral groove 112 thereby exerting a longitudinal force on the locking members causing the locking members to move longitudinally within the channel. The longitudinal movement of the locking members results in engagement or disengagement of the locking members with the inner periphery of the set ring 20 depending on whether the hub is being rotated clockwise or counter-clockwise. As shown in FIG. 17, the spiral grooves 112 are terminated with a continuous radius 114 such that when the pins 125 engage the continuous radius 114 there are no side forces exerted on the pins. This results in the pins being effectively locked into position, thereby locking the extended position of the locking members 120 and the corresponding engagement with the gear teeth 26 of the set ring 20. To permit accommodation of the hub into the binding assembly, the bottom plate 102 contains a hole 100, as shown in FIG. 18, to receive the bottom portion of the hub 111. The top plate 162 and locking disk 150 are modified with holes 160 and 132 respectively, to receive the top portion of the hub 117. Using methods generally known to one of ordinary skill in the art, the hub is also adapted with a keyed hole 118 along its top portion to permit the use of an allen key, screw driver or some other similar tool to facilitate rotating the hub during readjustment by the user of the second preset rotational position. To adjust the second preset rotational position of the binding assembly, the user first engages the pawl 42 with the notch 22 of the set ring 20. The hub 110 is then rotated such that the locking members 120 are retracted from engagement with the set ring 20. Once retracted, the binding assembly is rotated by the user to the new desired position and the hub 110 is rotated in the opposite direction to extend the locking members to engage with and lock the set ring at the new rotational position.

While the preferred alternate embodiment of the present invention utilizes a hub to urge the locking members to engage the inner periphery of the set ring, other suitable devices and variations can be used to achieve the same result. For example, the number of channels and corresponding locking members can be varied. Additionally, a spring latch mechanism can be disposed between the locking members such that compressive spring forces urge the locking members to engage the inner periphery and the latch can be used to manually retract the locking members. A cam connected to a lever, such that operation of the lever causes the cam to rotate, thereby engaging the locking members and urging the locking members into engagement with the inner periphery coupled with a spring mechanism to retract the locking members upon reversal of the cam may also be used.

During operation of the rotatably adjustable binding assembly, the foot base is initially adjusted so that the pawl 42 is engaged in the notch 4 of the bottom plate 2. In this position the binding assembly is set in its first rotational position suitable for "skateboard" maneuvering. To adjust to the second rotational position for a downhill ride, the foot tab 44 is actuated by the user's foot causing the detent lever to pivot about the pivot point 47 disengaging the pawl 42 from the notch 4. With the pawl 42 disengaged, the snowboarder rotates his or her foot, while maintaining the boot engagement in the binding assembly, thereby rotating the foot base to the second rotational position. During the rotating operation, the pawl 42 will travel along the cam surface 6 of the bottom plate 2, and along the cam surface 24 of the set ring 20. Upon reaching the second rotational position, the detent spring 80 will urge the pawl 42 to engage the notch 22 of the set ring 20, thereby securing the binding assembly at the second rotational position. To return the binding assembly to the first rotational position, the foot tab 44 is actuated by the user's foot and the process is repeated with the snowboarder's foot rotated in the opposite direction.

In another alternative embodiment of the present invention, the locking disk 50 and set ring 20 are integral and form a second plate element. The bottom plate 2 serves as a first plate element. In this embodiment, the rotational position of the notch 22 is fixed relative to the mounting slots 58 during manufacturing. Adjustment of the preset rotational position can only be achieved by varying the location of the notch 22 along the outer perimeter of the second plate element relative to the mounting slots.

In yet another alternative embodiment, a single plate element, containing a plurality of notches or other detent engaging elements disposed along the outer perimeter of the plate element and adapted to engage the pawl, is substituted for the bottom plate, set ring and locking disk. A plurality of rotational positions of the foot base are secured through engagement of the pawl with the individual detent engaging elements.

It is contemplated that the below-listed components of the present invention may be formed of the following materials: the bottom plate may be formed of 302 series stainless steel; the set ring may be formed of stainless steel, aluminum or injection molding; the detent lever may be formed of 12 gauge 304 series stainless steel; the detent spring may be formed of spring steel; the foot base may be formed of Verton™; the locking disk, locking members and hub may be formed of stainless steel, aluminum or injection molding; and the top plate may be formed of aluminum.

As shown and described above, the present invention provides a rotatable binding assembly that allows a snowboarder to quickly and easily rotate a snowboard binding from a first rotational position suitable for propelling the snowboard in "skateboard" fashion to a second rotational position suitable for downhill riding.

It is specifically contemplated that the present invention may be modified or configured as appropriate for the application. It is intended that the foregoing detailed description be regarded as illustrative rather than limiting, and it should be understood that the following claims, including any equivalents, are intended to define the scope of the invention.

We claim:

1. A rotatably adjustable snowboard binding assembly comprising:

a bottom plate secured to a snowboard, said bottom plate comprising a substantially circular shaped outer periphery, said outer periphery defining a first detent receiving element and a cam surface;

a foot base adapted for receiving and securing thereto a boot, said foot base disposed above said bottom plate and comprising an annular surface defining a through hole concentric with said bottom plate, said foot base capable of rotational movement about the axis of the through hole;

a detent lever pivotally mounted on said foot base, said detent lever having a first end and a second end, said second end protruding from said foot base;

a foot tab mounted on the second end of said detent lever, whereby said detent lever can be actuated by engaging said foot tab;

a detent member connected to the first end of said detent lever, said detent member being adapted to engage said first detent receiving element of said bottom plate whereby engagement of said detent member in said first detent receiving element secures said foot base at a first rotational position;

a set ring disposed below said annular surface of said foot base and concentric with the foot base through hole, said set ring capable of rotation about its axis, said set ring comprising an inner periphery and a substantially circular shaped outer periphery, said outer periphery defining a cam surface and a second detent receiving element adapted to engage said detent member, whereby engagement of said detent member in said second detent receiving element secures said foot base at a second rotational position;

a means for urging said detent member into said first detent receiving element when said foot base is positioned at said first rotational position and into said second detent receiving element when said foot base is positioned at said second rotational position;

a locking disk concentric with said set ring, said locking disk comprising an outer periphery adapted to matingly engage at least one portion of the inner periphery of said set ring, whereby said locking disk upon engagement with said set ring fixes the rotational position of said second detent receiving element;

a spring biasing means disposed between said bottom plate and said locking disk to urge said set ring from said locking disk to facilitate rotational adjustment of said set ring;

a top plate disposed above the annular surface of said foot base, said top plate substantially covering and extending over the foot base through hole; and means for securing said top plate to the snowboard whereby said foot base, said locking disk, and said bottom plate are also secured to the snowboard;

whereby said foot base is capable of rotational adjustment between said first and second rotational positions through operation of said detent lever and rotational maneuvering of said foot base.

2. The rotatably adjustable snowboard binding assembly as in claim 1 wherein said outer periphery of said locking disk comprises a plurality of gear teeth and said inner periphery of said set ring comprises a plurality of gear teeth operable to mate with the gear teeth of said locking disk.

3. A rotatably adjustable snowboard binding assembly capable of rotational adjustment between a first and a second rotational position wherein the second rotational position can be altered by the user, said binding assembly comprising:

a bottom plate secured to a snowboard, said bottom plate comprising a substantially circular shaped outer periphery, said outer periphery defining a first detent receiving element and a cam surface;

a foot base adapted for receiving and securing thereto a boot, said foot base disposed above said bottom plate and comprising an annular surface defining a through hole concentric with said bottom plate, said foot base capable of rotational movement about the axis of the through hole;

a detent lever mounted on said foot base, said detent lever having a first end and a second end, said second end protruding from said foot base;

a foot tab mounted on the second end of said detent lever, whereby said detent lever can be actuated by engaging said foot tab;

a detent member connected to the first end of said detent lever, said detent member being adapted to engage said first detent receiving element of said bottom plate whereby engagement of said detent member in said first detent receiving element secures said foot base at the first rotational position;

a set ring disposed below said annular surface of said foot base and concentric with the foot base through hole, said set ring capable of rotation about its axis, said set ring comprising an inner periphery and a substantially circular shaped outer periphery, said outer periphery defining a cam surface and a second detent receiving element adapted to engage said detent member, whereby engagement of said detent member in said second detent receiving element secures said foot base at the second rotational position;

a means for urging said detent member into said first detent receiving element when said foot base is positioned at the first rotational position and into said second detent receiving element when said foot base is positioned at the second rotational position;

a disk concentric with said set ring, said disk comprising an inner periphery defining at least one channel, at least one locking member slidably disposed within the channel of said disk, said locking member comprising a first and a second end, said first end being adapted to matingly engage a portion of the inner periphery of said set ring, whereby engagement of said first end with said set ring fixes the second rotational position;

means for urging said locking member to engage a portion of the inner periphery of said set ring;

a top plate disposed above the annular surface of said foot base, said top plate substantially covering and extending over the foot base through hole; and means for securing said top plate to the snowboard whereby said foot base, said locking disk, and said bottom plate are also secured to the snowboard.

4. The rotatably adjustable snowboard binding assembly as in claim 3 wherein the first end of said locking member comprises a plurality of gear teeth and said inner periphery of said set ring comprises a plurality of gear teeth operable to mate with the gear teeth of the first end of said locking member.

5. A binding assembly comprising:

a base adapted for receiving a boot, said base defining a through hole and capable of rotational movement about the axis of the through hole;

a detent mechanism mounted on said base;

a first plate adapted to engage said detent mechanism whereby engagement of said first plate with said detent mechanism secures said base at a first rotational position; and a second plate disposed concentric with the base through hole, said second plate adapted to engage said detent mechanism whereby engagement of said second plate with said detent mechanism secures said foot base at a second rotational position.

6. The binding assembly as in claim 5, further comprising a tab mounted on said detent mechanism, whereby said detent mechanism can be actuated by said tab to move said base between said first and second rotational positions.

7. The binding assembly as in claim 6, wherein said tab can be actuated by a user's foot.

8. The binding assembly as in claim 5, wherein said binding assembly is mounted to a snowboard.

9. A rotatably adjustable snowboard binding assembly comprising:

a first plate secured to a snowboard, said first plate comprising an outer periphery defining a first detent receiving element;

a base adapted for receiving a boot, said base disposed above said first plate and having a through hole concentric with said first plate, said base capable of rotational movement about the axis of the through hole;

a lever operably associated with said base, said lever having a first end and a second end, said second end protruding from said base;

a detent member connected to the first end of said lever, said detent member being adapted to engage said first detent receiving element of said first plate whereby engagement of said detent member in said first detent receiving element secures said base at a first rotational position;

a set ring disposed above said first plate and concentric with the base through hole, said set ring capable of rotation about its axis, said set ring comprising an inner periphery and an outer periphery, said outer periphery defining a second detent receiving element adapted to engage said detent member, whereby engagement of said detent member in said second detent receiving element secures said base at a second rotational position;

a disk concentric with said set ring, said disk comprising an outer periphery adapted to matingly engage at least one portion of the inner periphery of said set ring, whereby said disk upon engagement with said set ring fixes the rotational position of the second detent receiving element of said set ring;

a second plate disposed above the through hole of said base and said disk, said second plate substantially covering and extending over the through hole of said base; and means for securing said second plate to said first plate whereby said base is secured to the snowboard;

wherein said binding assembly is capable of rotational adjustment between said first and second rotational positions through operation of said lever and rotational movement of said base.

10. The rotatably adjustable snowboard binding assembly as in claim 9 wherein said lever is pivotally mounted to said base.

11. The rotatably adjustable snowboard binding assembly as in claim 9 wherein said first plate further comprises a cam surface on a portion of the outer periphery, the cam surface defining a path of travel of said detent member.

12. The rotatably adjustable snowboard binding assembly as in claim 9 wherein said set ring further comprises a cam surface on a portion of the outer periphery, said cam surface defining a path of travel of said detent member.

13. The rotatably adjustable snowboard binding assembly as in claim 9, further comprising spring biasing means disposed between said first plate and said disk to urge said disk from said set ring to facilitate rotational adjustment of said set ring.

14. The binding assembly as in claim 9, further comprising a tab mounted on said detent mechanism, whereby said detent mechanism can be actuated by said tab to move said base between said first and second rotational positions.

15. The binding assembly as in claim 14 wherein said tab can be actuated by a user's foot.

16. The rotatably adjustable snowboard binding assembly as in claim 9 wherein said disk is integrally connected to said second plate.

17. The rotatably adjustable snowboard binding assembly as in claim 9 wherein the outer periphery of said disk comprises a plurality of gear teeth and the inner periphery of said set ring comprises a plurality of gear teeth operable to mate with the gear teeth of said disk.

18. The rotatably adjustable snowboard binding assembly as in claim 9 wherein said first rotational position corresponds to approximately 20 degrees from the longitudinal axis of the snowboard.

19. The rotatably adjustable snowboard binding assembly as in claim 9, further comprising a means for urging said detent member into said first detent receiving element when said base is positioned at said first rotational position and into said second detent receiving element when said base is positioned at said second rotational position.

20. The rotatably adjustable snowboard binding assembly as in claim 9 wherein said lever, said disk and said set ring are disposed under said base.

21. The rotatably adjustable snowboard binding assembly as in claim 9 wherein the through hole of said base is defined by an annular surface.

22. The rotatably adjustable snowboard binding assembly as in claim 21 wherein said set ring is disposed below said annular surface and said second plate is disposed above said annular surface.

23. A rotatably adjustable snowboard binding assembly capable of rotational adjustment between a first and a second rotational position wherein the second rotational position can be altered by the user, said binding assembly comprising:

a base adapted for receiving a boot, said base defining a through hole and capable of rotational movement about the axis of the through hole;

a detent mechanism mounted on said base;

a first plate adapted to engage said detent mechanism whereby engagement of said first plate with said detent mechanism secures said base at the first rotational position;

a second plate disposed concentric with the base through hole and capable of rotational movement about its axis, said second plate adapted to engage said detent mechanism whereby engagement of said second plate with said detent mechanism secures said foot base at the second rotational position; and a locking assembly operably associated with said second plate.

24. The rotatably adjustable snowboard binding assembly as in claim 23 wherein said second plate comprises a set ring, said set ring comprising an inner periphery operably associated with said locking assembly.

25. The rotatably adjustable snowboard binding assembly as in claim 26 wherein said locking assembly comprises:

a disk concentric with said set ring, said disk comprising an inner periphery defining at least one channel;

at least one locking member slidably disposed within the channel of said disk, said locking member comprising a first and second end, said first end being adapted to matingly engage a portion of the inner periphery of said set ring, whereby engagement of said first end with said set ring fixes said second rotational position; and means for urging said locking member to engage a portion of the inner periphery of said set ring.

26. The rotatably adjustable snowboard binding assembly as in claim 25, further comprising a second locking member slidably disposed within the channel of said disk, said second locking member comprising a first and second end, said first end being adapted to matingly engage a portion of the inner periphery of said set ring.

27. The rotatably adjustable snowboard binding assembly as in claim 26 wherein said first and second locking members are oppositely disposed within the channel of said disk.

28. The rotatably adjustable snowboard binding assembly as in claim 25 wherein the first end of said locking member comprises a plurality of gear teeth and said inner periphery of said set ring comprises a plurality of gear teeth operable to mate with the gear teeth of the first end of said locking member.

29. The rotatably adjustable snowboard binding assembly as in claim 25, wherein said means to urge said locking member to engage a portion of said inner periphery comprises a hub operably associated with the second end of said locking member so that rotation of said hub causes said locking member to longitudinally move within the channel of said disk.

* * * * *